US008499522B1

(12) United States Patent
Skidmore et al.

(10) Patent No.: US 8,499,522 B1
(45) Date of Patent: Aug. 6, 2013

(54) LIGHTWEIGHT CONCRETE MASONRY VENEER UNIT

(75) Inventors: David A. Skidmore, Bluefield, VA (US); James Barry Link, Abingdon, VA (US)

(73) Assignee: E. Dillon & Company, Swords Creek, VA (US)

( * ) Notice: Subject to any disclaimer, the term of this patent is extended or adjusted under 35 U.S.C. 154(b) by 1693 days.

(21) Appl. No.: 10/814,892

(22) Filed: Mar. 31, 2004

(51) Int. Cl.
*E04C 2/04* (2006.01)

(52) U.S. Cl.
USPC ..... 52/602; 52/630

(58) Field of Classification Search
USPC ..... 52/630, 596, 602
See application file for complete search history.

(56) References Cited

U.S. PATENT DOCUMENTS

| | | | | | |
|---|---|---|---|---|---|
| 378,825 | A * | 2/1888 | Brannigan | 404/34 |
| 650,824 | A * | 6/1900 | Cottom | 52/437 |
| 776,409 | A * | 11/1904 | Mather | 52/351 |
| 1,083,323 | A * | 1/1914 | Harlow | 52/596 |
| 1,487,526 | A * | 3/1924 | Bashlin | 52/602 |
| 1,651,893 | A * | 12/1927 | Jorgensen | 52/372 |
| 1,675,093 | A * | 6/1928 | Conley | 52/351 |
| 1,963,410 | A * | 6/1934 | Kartowicz | 52/481.2 |
| 2,018,201 | A * | 10/1935 | Currie | 52/503 |
| 2,058,285 | A * | 10/1936 | Amescua | 52/262 |
| 2,321,638 | A * | 6/1943 | Williams | 264/71 |
| 2,657,153 | A * | 10/1953 | Russell | 427/393.6 |
| 2,667,664 | A * | 2/1954 | Ferrell | 264/72 |
| 2,813,305 | A * | 11/1957 | Robson et al. | 264/600 |
| 4,514,947 | A * | 5/1985 | Grail | 525/36 |
| 4,566,235 | A | 1/1986 | Groll | |
| 4,963,305 | A | 10/1990 | Cromrich et al. | |
| 5,226,273 | A * | 7/1993 | Burke | 52/390 |
| 6,058,672 | A * | 5/2000 | McClellan | 52/587.1 |
| 6,253,515 | B1 * | 7/2001 | Kuelker | 52/506.05 |
| 6,606,835 | B1 | 8/2003 | Bilka | |
| 2005/0081469 | A1 * | 4/2005 | Price | 52/596 |

* cited by examiner

*Primary Examiner* — Brian Glessner
*Assistant Examiner* — Adriana Figueroa

(57) ABSTRACT

A lightweight concrete masonry unit for veneering the face of a building. The veneer block includes a body with planar front, top, bottom, and side surfaces with the top, bottom, and sides perpendicular to the front surface. One or more channels are formed in the rear surface. The depth of the channels are restricted to maintain no less than one inch of remaining wall thickness between the channel bottoms and the opposite front surface. The novel shape and larger minimum wall thickness of the lightweight veneer block enables production on a commercial block machine within the standard cycle time, provides weight and raw material cost savings up to 50%, and allows block heights that are not attainable with conventional hollow core veneer blocks.

1 Claim, 5 Drawing Sheets

LIGHTWEIGHT CONCRETE MASONRY VENEER UNIT

FIELD OF THE INVENTION

The present invention relates to concrete masonry for veneering the face of a building and particularly to a large concrete masonry unit that can be produced on conventional block making equipment.

BACKGROUND OF THE INVENTION

Concrete masonry units (CMU) are typically produced in commercial block machines. The standard sized CMU or concrete block produced is 8 inches tall by 8 inches wide by 16 inches long and includes two large cores. This block is referred to as the 8-inch block and is the standard of the industry.

A block machine typically makes three 8" blocks at a time, and those blocks are typically compressed and formed in about 10 seconds on the machine. The blocks are free standing after the forming step, and are then transported to a kiln in which low-pressure steam heat is applied to cure the concrete.

Another product that is commonly produced by the masonry industry is the concrete masonry veneer unit. As the veneer units are used to provide a facade on a building, they do not require the structural strength of an 8" block and are typically produced with a 4-inch width. Although the standard veneer unit is typically 8" tall by 16" long, larger sizes are also desirable, including 12" tall by 16" long or even 16" tall by 24" long. To reduce the cost of the veneer units, block makers have added interior cores to the veneer block. The conventional veneer block produced on a commercial block machine is a nominal size of 8" tall by 16" long by 4" wide.

During a ten second block making cycle, the mold goes into place in the machine, a feed drawer moves overhead with the concrete mix, the mix goes into the mold and slightly overfills it while at the same time the mold is vibrated mechanically to cause the mix to flow rapidly to the bottom of the mold, and an overhead compressive ram moves down and compresses the mix in the mold into its final shape. A standard 8" block has a face shell thickness of about 1 inch. For the pour cycle of the block machine, the 1" opening for the face shell becomes a limitation on production, as it is difficult to get the mix to drop down and fill the mold in the allotted cycle time. This becomes even more difficult when producing a standard veneer block, which has a face shell thickness of about ¾". It is difficult to get the mix to flow into the narrow face shell area in the short time frame of the block making cycle. It is therefore very difficult to produce conventional hollow core veneer blocks on a commercial block machine, as a result of the difficulty in getting the mix to flow into the narrow mold in the short duration of the block making cycle.

There is now an increased demand for veneer blocks taller than the standard 8" size. The added height of the taller hollow core veneer blocks makes it even more difficult to produce them in a commercial block machine. Tall veneer blocks, such as those 12" tall by 16" long or 16" tall by 24" long, are therefore produced as solid rectangular shaped blocks, which, since they lack cores and therefore lack the narrow face shell cavities in the mold, are easily filled by a commercial block machine. Although solid rectangular shaped veneer blocks are adequate for veneering the face of a building, they are not optimal as the solid block adds to both its weight and production cost.

What is needed therefore is a block that can be produced on a commercial block machine within a standard production cycle but with the weight and cost advantages of a conventional hollow core block.

The object of the present invention is to provide a veneer block having the weight and production cost advantages of a hollow core block but without a narrow face shell that limits production in a standard block machine.

These, and other objects and advantages will be apparent to a person skilled in the art by reading the attached description along with reference to the attached drawings.

SUMMARY OF THE INVENTION

According to the present invention, there is provided a lightweight concrete masonry unit for veneering the face of a building. The veneer block includes a body with planar front, top, bottom, and side surfaces with the top, bottom, and sides perpendicular to the front surface. One or more channels are formed in the rear surface. The depth of the channels are restricted to maintain no less than one inch of remaining wall thickness between the channel bottoms and the opposite front surface. The novel shape and larger minimum wall thickness of the lightweight veneer block enables production on a commercial block machine within the standard cycle time, realizes weight and raw material cost savings up to 50%, and allows block heights heretofore not attainable with conventional hollow core veneer blocks.

TABLE OF NOMENCLATURE

Figure 1:
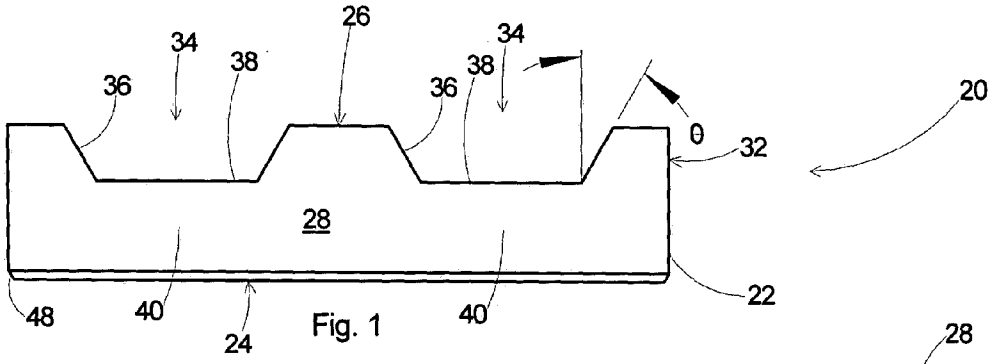
FIG. 1 is a top view of a preferred embodiment of a veneer masonry unit according to the present invention.

The following is a listing of part numbers used in the drawings along with a brief description:

| Part Number | Description |
|---|---|
| 20 | concrete masonry unit or veneer block |
| 22 | body |
| 24 | front surface |
| 26 | rear surface |
| 28 | top surface |
| 30 | bottom surface |
| 32 | side surface |
| 34 | channel |
| 36 | sidewall of channel |
| 38 | channel bottom |
| 40 | web section |
| 42 | lower row of veneer blocks |

-continued

| Part Number | Description |
|---|---|
| 44 | building structure |
| 46 | veneer block, second embodiment |
| 48 | front edge or chamfered edge of block |

DETAILED DESCRIPTION

Figure 2:
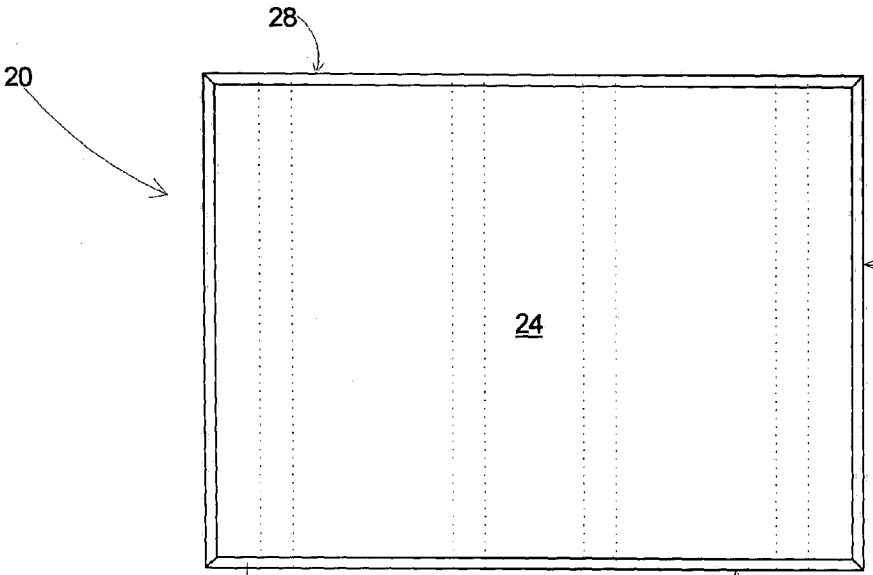
FIG. 2 is a front view of the veneer masonry unit of FIG. 1.
Figure 3:
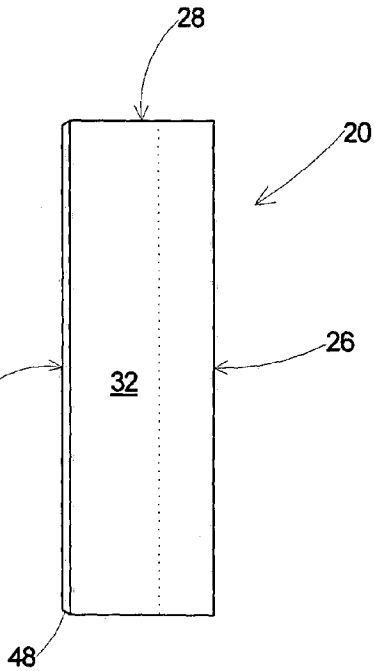
FIG. 3 is a side view of the veneer masonry unit of FIG. 1.

Referring to FIGS. 1-3, there is shown the preferred embodiment of a concrete masonry unit 20 for veneering the face of a building. The concrete masonry unit or veneer block 20 includes a body 22 with a substantially planar front 24 surface and a rear 26, top 28, bottom 30, and side 32 surfaces planar and perpendicular to the front surface 24. The veneer block 20 includes one or more channels 34 formed in the rear surface 26. The channels 34 have sidewalls 36 and a channel bottom 38. The preferred embodiment of the veneer block 20 includes two channels 34 as shown in FIGS. 1-3.

As a result of the channels 34 formed in the rear surface 26, the narrowest part of the block body 22 is the web section 40 between the channel bottom 38 and the front surface 24. The veneer block 20 of the present invention is typically formed in a commercial block machine and it is therefore desirable to maintain the web section 40 at a thickness, between the channel bottom 38 and the front surface 24, of at least one inch. Maintaining the web section 40 at one inch or more ensures that the entire veneer block 20, including the web section 40, will be formed correctly within the short cycle time of the block machine. The present invention therefore provides a lightweight veneer block 20 that achieves its weight advantage without the inclusion of internal hollow cores. Conventional concrete masonry units for veneering typically include hollow cores to achieve a weight and cost advantage. However, for a veneer block having a 4-inch depth, the addition of hollow cores creates a narrow shell face that limits the height to which the veneer block can be produced in a commercial block machine.

The size of veneer blocks are commonly specified by their thickness or depth, height, and length. The preferred embodiment of the veneer block 20 depicted in FIGS. 1-3 has a nominal dimension of 4 inches thick by 12 inches tall by 16 inches long. The height of the block 20 is measured between the bottom 30 and top 28 surfaces, the length between the two side surfaces 32 and the depth between the front 24 and rear 26 surfaces. For a nominal veneer block size of 4"×12"×16", such as the preferred embodiment, the actual dimensions of the block 20 are 3⅝×11⅝"×15¾". Veneer blocks according to the present invention can also be produced in other nominal sizes, such as 4"×8"×12", 4"×8"×16", 4"×12"×12", 4"×12"×24", or 4"×16"×24".

Figure 4:
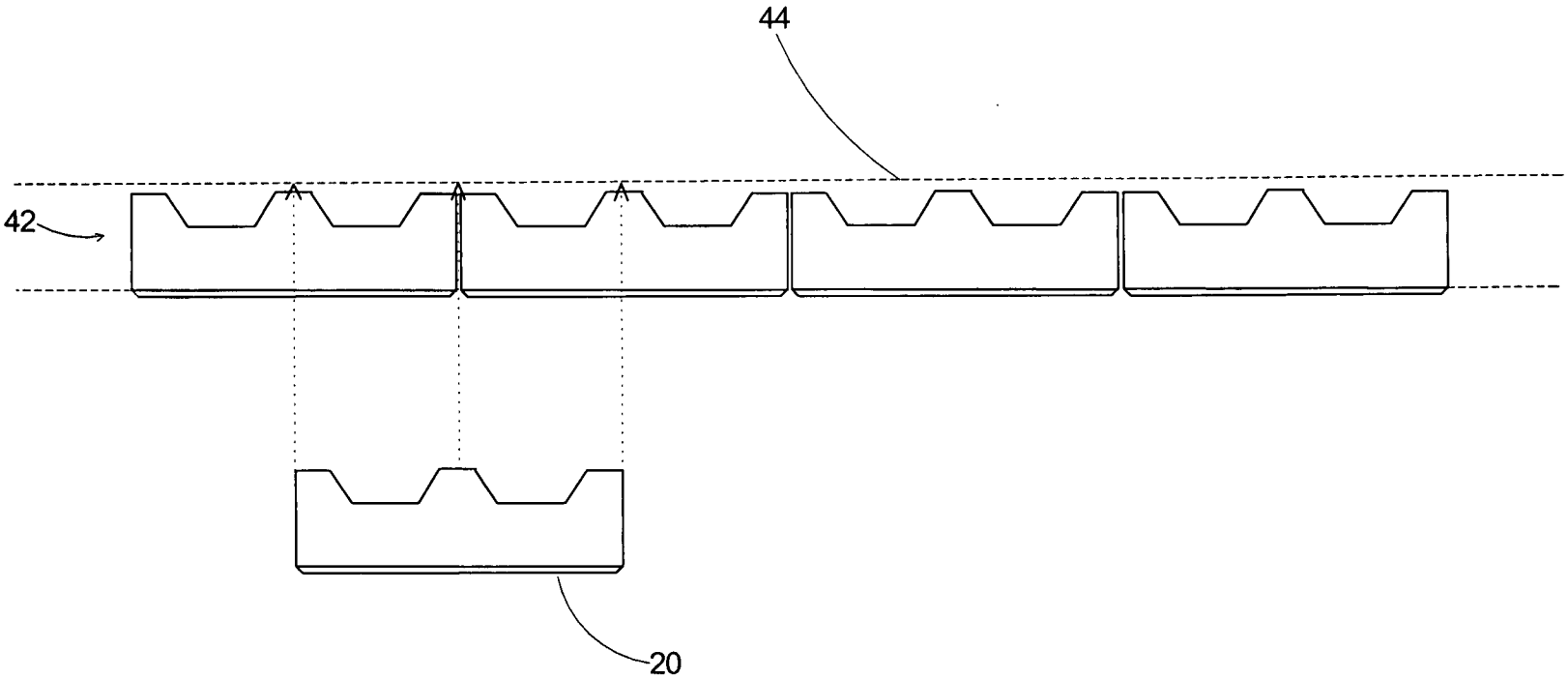
FIG. 4 is an overhead view of the veneer masonry unit of FIG. 1 being placed into position on a bed of lower veneer units adhered to the facade of a building.
Figure 5:
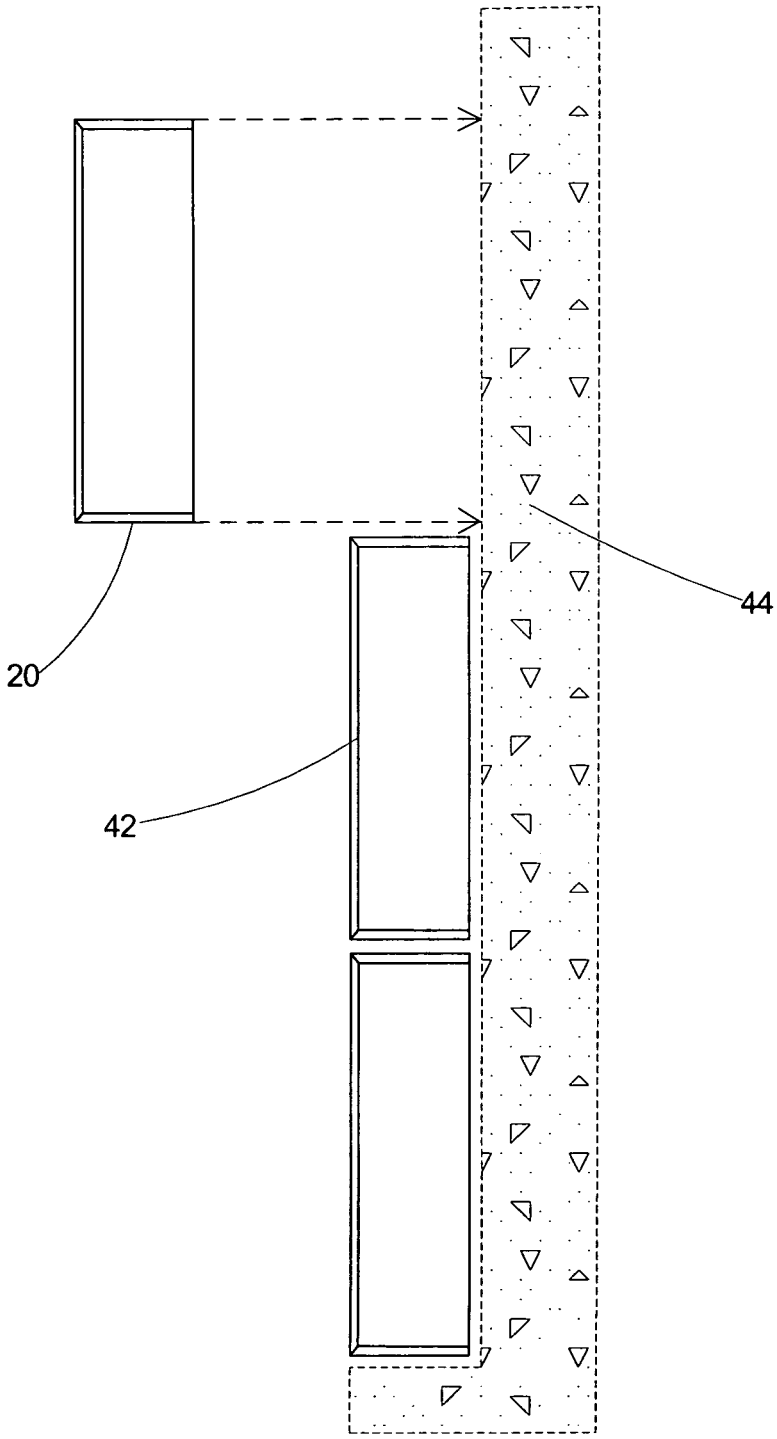
FIG. 5 is a side view of the veneer masonry unit of FIG. 1 being placed into position on a bed of lower veneer units adhered to the facade of a building.
Figure 6:
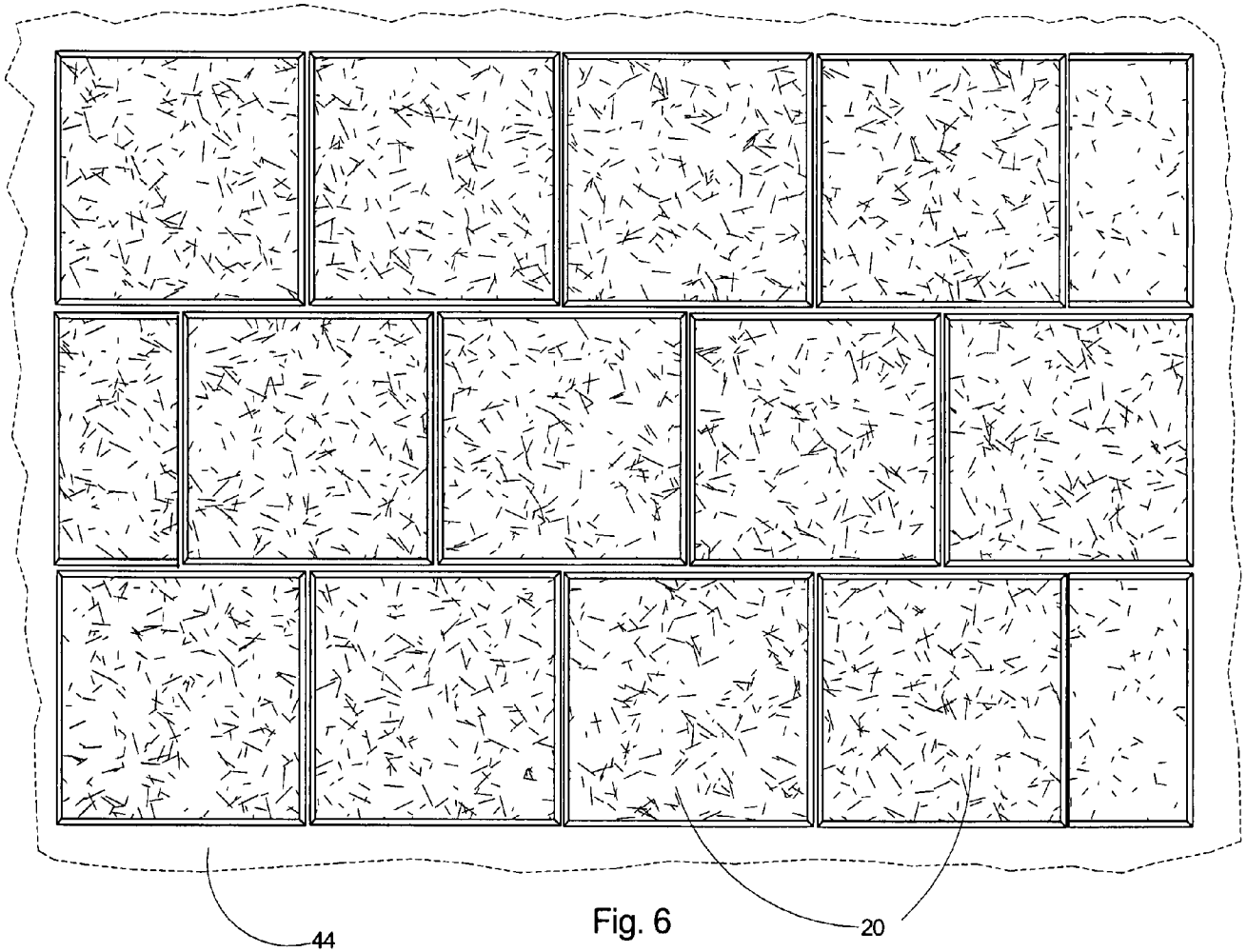
FIG. 6 is a front view of a portion of a finished building facade constructed with the veneer masonry units of FIG. 1.

Veneer blocks are typically installed on a building structure by one of two methods. One method, anchored veneer, involves mechanical fasteners such as wall ties for securing the blocks to the structure. A second method, adhered veneer, involves a bonding material such as mortar for securing the blocks to the structure. FIG. 4 depicts a conceptual overhead view of a veneer block 20 according to the present invention being fitted into position upon a lower row 42 of veneer blocks that have been adhered to the building structure 44. Workable mortars with high bond properties are typically used to adhere the blocks to the building structure. FIG. 5 depicts a side conceptual view of a veneer block 20 being fitted in place on a lower row 42 of blocks against a building structure 44. FIG. 6 depicts a front conceptual view of a finished building structure with veneer blocks 20 adhered to the structure.

Figures 7, 8, 9:
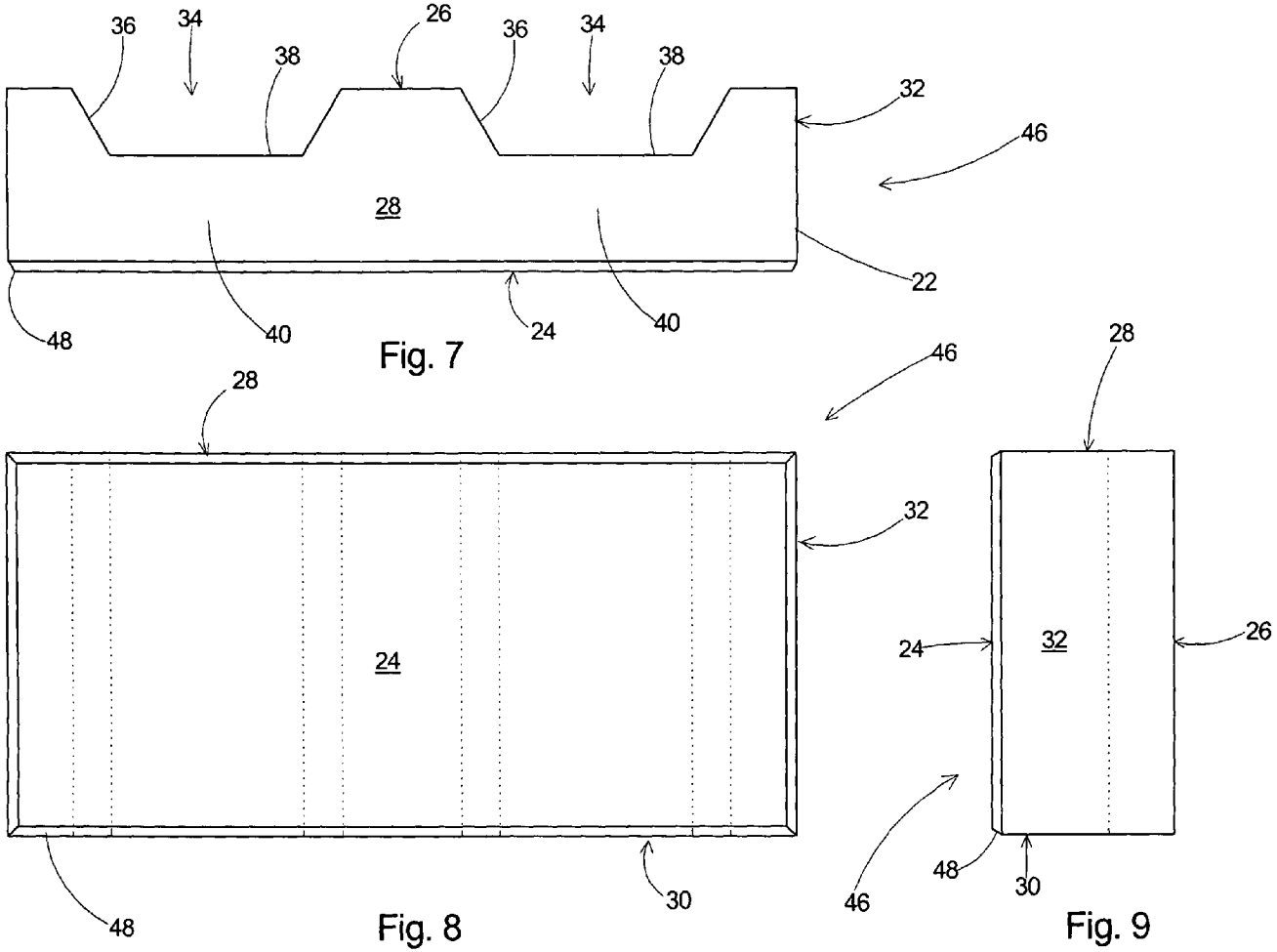
FIG. 7 is a top view of an alternative embodiment of a veneer masonry unit according to the present invention.
FIG. 8 is a front view of the veneer masonry unit of FIG. 7.
FIG. 9 is a side view of the veneer masonry unit of FIG. 7.

Referring to FIGS. 7-9, an alternative embodiment is shown of a 4"×8"×16" nominal veneer block 46 according to the present invention. The preferred actual dimensions of this block are 3⅝"×7⅝"×15¾".

With reference to FIGS. 1-3, the preferred embodiment of the veneer block 20 has a nominal dimension of 4"×12"×16" or an actual dimension of 3⅝"×11⅝"×15¾". The depth of the channel 34 from the rear surface 26 of the block, which is measured from the rear surface 26 to the channel bottom 38, is preferably 1.313 inches. The width of the channel 34 at the rear surface 26 is preferably 5⅜ inches. The angle of the sidewall 36 of the channel 34 with respect to the rear surface 26 is preferably 60 degrees. With these channel dimensions, the weight of the preferred embodiment of the veneer block 20 according to the present invention is reduced by 21 percent. This weight savings produces several advantages over a standard rectangular shaped veneer block, including lower production cost as a result of less raw materials consumed, lower shipping costs, and increased ease in handling of the blocks. By varying the depth of the channel, it is possible to obtain raw material and weight savings of up to 50% with the lightweight concrete masonry veneer unit of the present invention.

The present invention therefore enables the production of lower weight veneer blocks in a commercial block machine without limiting the height of the blocks. The veneer block of the present invention achieves this by its novel shape, which achieves the weight savings without adding interior cores to the block. The novel shape also enables easy production of tall veneer blocks, such as blocks greater than 7 inches in height, which are difficult to achieve in a hollow core veneer block as a result of the narrow shell thickness.

Although the veneer block of the present invention has preferably two channels, it could also be produced with one, three, or other channels, as long as the design provides adequate bottom and rear surface area for bonding to the building structure. Also the invention is not restricted to channels shaped as shown herein. The channel sidewalls could be at other angles or could be curved instead of straight, if preferred, as long as the veneer block were designed to be stable when standing on its bottom surface. For the preferred embodiment shown in FIGS. 1-3, the sidewalls 36 of the channels 34 are preferably at an angle θ of between 10 and 40 degrees with respect to the channel bottom 38 and most preferably at an angle of 30 degrees with respect to the channel bottom 38. In the preferred embodiment, the bottom 38 of each of the channels 34 resides in a plane parallel with the front surface 24 of the body. The bottoms 38 of the channels 34 are preferably between 1.31 and 1.87 inches in depth with respect to the rear surface 26 of the body 22.

As shown in FIGS. 1-3, the veneer block 20 also includes a front edge 48 at the intersection of the front surface 24 with the top 28, bottom 30, and side surfaces 32. The front edge 48 is preferably chamfered at an angle of 60 degrees with respect to the front surface and to a depth of 0.219 inch from the front surface. The chamfered edge 48 establishes a smooth surface adjacent to the front surface 24 or face of the block 20 allowing a mason to easily and quickly tool the joint between blocks after adhering the block to a building structure.

To enhance the attractiveness of the veneer block 20, the front surface 24 or face of the block can include a glossy finish. This is achieved by controlling the raw ingredients, the particle size distribution of the ingredients, and by a multiple step finishing process including grinding and sanding the face of the block.

The rear surface 26 of the veneer block 20, including the channel sidewalls 36 and channel bottom 38, has unglazed surfaces. The rear surface 26 is unglazed to facilitate better adhesion to workable mortars.

The veneer concrete masonry block is typically designed to support the anticipated weight of successive tiers of overhead blocks. Preferably the block has a compressive strength of 1900 psi or greater.

As the invention has been described, it will be apparent to those skilled in the art that the embodiments shown herein may be varied in many ways without departing from the spirit and scope of the invention. Any and all such modifications are intended to be included within the scope of the appended claims.

What is claimed is:

1. A concrete masonry veneer unit produced in a block machine from a concrete mix comprising:

a homogeneous concrete body with front, rear, top, bottom, and side surfaces;

a substantially planar front surface including a glossy finish on said front surface formed by grinding and sanding said front surface of said concrete body;

a flat chamfered edge between said front surface and said top, bottom, and side surfaces;

said top, bottom, and side surfaces having uninterrupted planar surfaces perpendicular to said front surface;

said rear surface of said body is flat;

two unglazed channels formed in said rear surface of said body with open ends at said top and bottom surfaces;

said channels including a channel bottom and channel sidewalls;

a web section between said channel bottom and said front surface;

said bottom of each of said channels resides in a plane parallel with said front surface of said body;

said sidewalls of said channels are at an angle of between 20 and 40 degrees with respect to an axis perpendicular to said channel bottom;

said web section having a minimum thickness of at least one inch; and said veneer unit including a compressive strength of 1900 psi or greater.

* * * * *